US005616071A

United States Patent [19]

Herrmann

[11] Patent Number: 5,616,071

[45] Date of Patent: Apr. 1, 1997

[54] BEVEL GRINDER

[76] Inventor: Heinz Herrmann, Leipziger Strasse 105, D-47918 Tönisvorst, Germany

[21] Appl. No.: 435,173

[22] Filed: May 5, 1995

[30] Foreign Application Priority Data

May 6, 1994 [DE] Germany ..... 9407523 U
Mar. 22, 1995 [DE] Germany ..... 295 04 834.4

[51] Int. Cl.[6] ..... B24B 7/00

[52] U.S. Cl. ..... 451/259; 451/549

[58] Field of Search ..... 451/44, 164, 259, 451/278, 178, 541, 231, 444, 449, 450, 545, 549, 237, 241; 144/134 R, 134 A, 134 C, 136 D, 144 R; 408/241 S; 409/218

[56] References Cited

U.S. PATENT DOCUMENTS 4,322,915 4/1982 Kindig ..... 451/44
4,375,738 3/1983 Bando ..... 451/44
4,517,769 5/1985 Fujimoto ..... 451/541
4,733,997 3/1988 Ford et al. ..... 144/144 A
5,345,726 9/1994 Gach ..... 451/450
5,433,652 7/1995 Park ..... 451/44
5,476,410 12/1995 Lupi ..... 451/44

*Primary Examiner*—D. S. Meislin
*Assistant Examiner*—Andrew Weinberg
*Attorney, Agent, or Firm*—Herbert Dubno; Andrew Wilford

[57] ABSTRACT

A bevel grinder for an edge of a sheet workpiece of predetermined thickness has a generally planar support on which the workpiece lies, a head having a frustoconical grinding surface centered on an axis substantially perpendicular to the support and rotatable about the axis, and a drive connected to the head for rotating same about the axis with the surface engaging the sheet at the edge and for relatively displacing the head and workpiece. Thus the head moves along the edge so that a bevel is ground in the edge. A spacer on the head projects axially therefrom toward the support and has an axial dimension smaller than the workpiece thickness.

6 Claims, 2 Drawing Sheets

BEVEL GRINDER

FIELD OF THE INVENTION

The present invention relates to a bevel grinder. More particularly this invention concerns an apparatus for grinding a bevel on an edge of a hard plate workpiece, for instance a sheet of glass.

BACKGROUND OF THE INVENTION

A standard glass-grinding or -polishing apparatus has a cylindrical drum whose surface is covered with grit typically in the form of carbide, carborundum, or diamond particles. This drum is rotated about its axis while it is urged radially against the surface to be ground or polished.

Such a device is relatively efficient at smoothing the perpendicular edge of a piece of glass but cannot be used to bevel an edge. To do so requires orienting the axis of the drum at an angle to the support on which the sheet is lying, and then accurately moving the drum. Such operation is impossible to effect with smooth results.

OBJECTS OF THE INVENTION

It is therefore an object of the present invention to provide an improved bevel grinder.

Another object is the provision of such an improved bevel grinder which overcomes the above-given disadvantages, that is which allows a bevel to be ground on a sheet workpiece in a simple manner producing smooth results.

SUMMARY OF THE INVENTION

A bevel grinder for an edge of a sheet workpiece of predetermined thickness has according to the invention a generally planar support on which the workpiece lies, a head having a frustoconical grinding surface centered on an axis substantially perpendicular to the support and rotatable about the axis, and a drive connected to the head for rotating same about the axis with the surface engaging the sheet at the edge and for relatively displacing the head and workpiece. Thus the head moves along the edge so that a bevel is ground in the edge. A spacer on the head projects axially therefrom toward the support and has an axial dimension smaller than the workpiece thickness.

Thus with this system the grinding surface will inherently extend at a normally very small acute angle, substantially less than 10°, to the support plane to produce an extremely smooth bevel. The width of the bevel is controlled by the vertical setting of the head relative to the support. The spacer prevents the head from bumping the support and grinding a hole in it.

According to the invention the support includes a foraminous upper wall on which the workpiece sits and a sponge sitting on the wall adjacent the workpiece and in engagement with the head surface. The support further includes means for maintaining the sponge wet in that the support is a vessel containing a body of coolant liquid. The sponge is engaged in the liquid body. Thus as the head rotates it picks up the liquid, typically water, from the sponge while the sponge cleans the grit surface of particles thereon.

The head in accordance with this invention is removable from the drive and is replaceable by heads with grinding surfaces of different grits. Heads with coarse grit for roughing, medium grit for smoothing, and very fine grit for polishing can be used.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
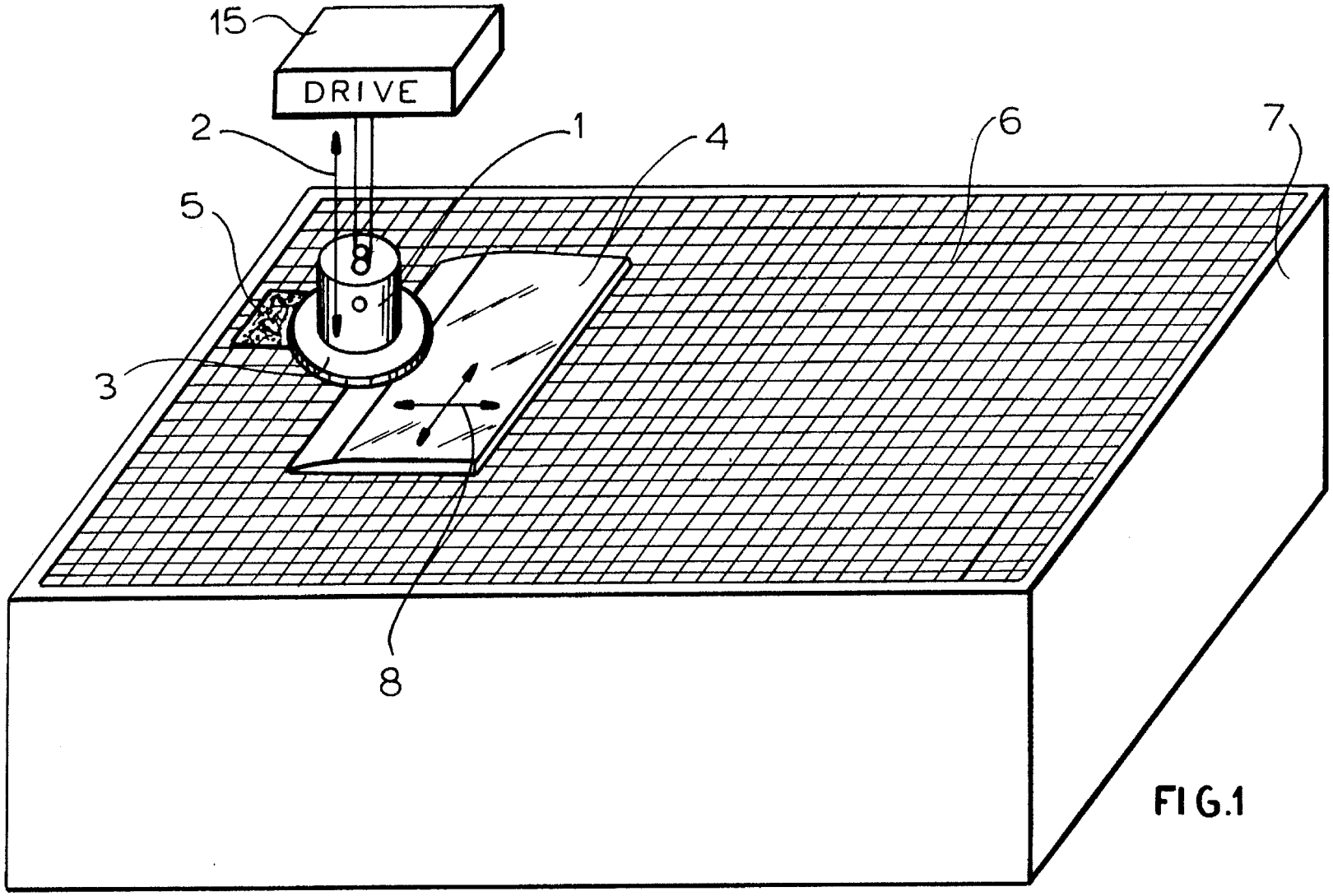
FIG. 1 is a partly diagrammatic perspective view of the grinder according to the invention.
Figure 2:
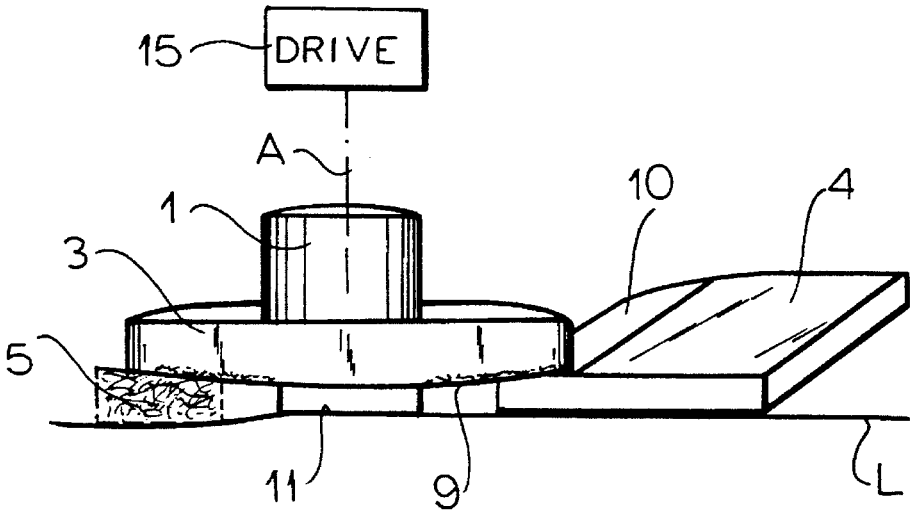
FIG. 2 is a side view of the apparatus.

As seen in FIGS. 1 and 2 a bevel grinder according to this invention has a head 1 rotatable by a drive 15 about a vertical axis A and provided with a grinding disk 3 and movable by the drive 15 vertically as indicated by arrow 2 and horizontally in two mutually perpendicular directions as indicated by arrows 8. The disk 3 has a frustoconical lower face 9 centered on the axis and covered with abrasive grit. The apex angle of the frustocone of the surface 9 is normally in excess of 175°. On its lower surface the head 1 carries a spacer 11 centered on the axis A and having a lower surface perpendicular to the axis A.

A plate workpiece 4, here a sheet of glass, sits atop a planar and foraminous support formed by a stiff screen or grid 6 covering the top of a water-filled vessel or box 7 whose liquid level L is just at the level of the screen 6. The axis A is perpendicular to the screen 6 and diametrically opposite the workpiece 4 is a sponge 5 which therefore has a lower surface sitting in the body of water.

Thus as the tool head 3 moves along the workpiece 4 it will form a bevel 10 along its edge. The grinding zone will be cooled and lubricated as the head 3 picks up liquid from the sponge 5, and particles on the surface 9 will be scraped off it onto this sponge 5. Of course instead of moving the grinder head 1 and holding the workpiece 4 still, the drive 15 can be connected to the workpiece 4 to displace it past the rotating but otherwise stationary disk 3.

Figure 3A:
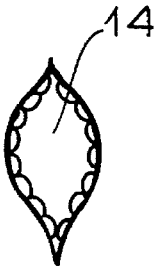
FIGS. 3A through 3C are top views of workpieces with edges beveled according to the invention.
Figure 3B:
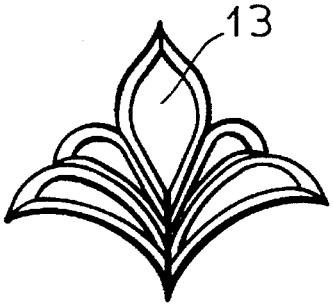
Figure 3C:
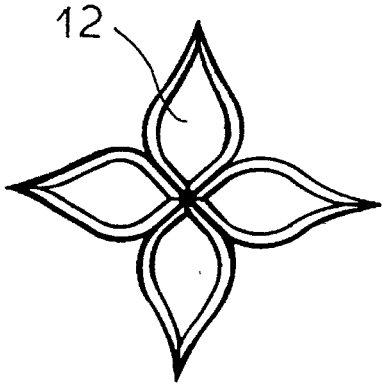

FIG. 3A shows how a scalloped edge can be produced on a workpiece 14 by limitedly vertically reciprocating the head 3 while moving it around the periphery of the workpiece. More complex pieces 13 and 12 assembled respectively from five and four beveled-edge parts are shown in FIGS. 3B and 3C.

I claim:

1. A bevel grinder for an edge of a sheet workpiece of predetermined thickness, the grinder comprising:

a generally planar support on which the workpiece lies;

a head having a frustoconical grinding surface centered on an axis substantially perpendicular to the support and rotatable about the axis;

a spacer on the head projecting axially therefrom toward the support, having an end surface engageable axially with the support, and having an axial dimension smaller than the workpiece thickness; and drive means connected to the head for rotating the head about the axis with the grinding surface engaging the sheet at the edge with the spacer end surface pressed axially against the support but out of contact with the workpiece, said drive means for relatively displacing the head and workpiece such that the head moves along the edge, whereby a bevel is ground in the edge.

2. The bevel grinder defined in claim 1 wherein the support includes a foraminous upper wall on which the workpiece sits, and a sponge sitting on the wall adjacent the workpiece and in engagement with the head surface.

3. The bevel grinder defined in claim 1 wherein the head is removable from the drive means and is replaceable by heads with grinding surfaces of different grits.

4. The bevel grinder defined in claim 2 wherein the support further includes means for maintaining the sponge wet.

5. The bevel grinder defined in claim 4 wherein the support is a vessel containing a body of coolant liquid constituting the wetting means, the sponge being engaged in the liquid body.

6. The bevel grinder defined in claim 4 wherein the end surface is perpendicular to the axis.

* * * * *